United States Patent [19]

Anderson

[11] 4,243,109

[45] Jan. 6, 1981

[54] BI-DIRECTIONAL ROTARY IMPACT TOOL FOR APPLYING A TORQUE FORCE

[75] Inventor: J. Edward C. Anderson, Moreland Hills, Ohio

[73] Assignee: Marquette Metal Products Company, Fountain Inn, S.C.

[21] Appl. No.: 46,477

[22] Filed: Jun. 7, 1979

[51] Int. Cl.[3] ..... B25D 15/02

[52] U.S. Cl. ..... 173/93.5; 81/466

[58] Field of Search ..... 173/93.5, 93, 93.6, 173/93.7, 48; 81/52.3, 62, 63, 63.1, 63.2; 64/27 R

[56] References Cited

U.S. PATENT DOCUMENTS

| | | | |
|---|---|---|---|
| 3,108,506 | 10/1963 | Swenson | 81/52.3 |
| 3,156,309 | 11/1964 | Swenson | 173/93 |
| 3,180,185 | 4/1965 | Schmidt et al. | 173/93 |
| 3,648,784 | 3/1972 | Schoops | 173/93.5 |
| 4,157,120 | 6/1979 | Anderson | 173/93 |

*Primary Examiner*—Werner H. Schroeder

*Assistant Examiner*—Andrew M. Falik

*Attorney, Agent, or Firm*—Arthur L. Frederick

[57] ABSTRACT

A rotary impact tool of the type for applying a torque force and having an input, output and spring-accelerated inertia members and journaled on each other for rotative movement relative to each other and a cam connected for conjoined rotation with the input member and for actuating juxtaposed pawls carried by the inertia member into and out impact engagement with circumferentially spaced teeth on the output member for driving the latter, the cam being so shaped and positioned relative to the input inertia and output members to coact with the pawls so as to provide impact engagement of the pawls with the spaced teeth of the output member in both directions of rotation. In another aspect of the invention, the cam is capable of angular adjustment relative to the input and inertia members to predetermined positions to achieve impact driving forces of different magnitude or to apply impact driving force in one direction or the opposite direction of rotation.

21 Claims, 11 Drawing Figures

BI-DIRECTIONAL ROTARY IMPACT TOOL FOR APPLYING A TORQUE FORCE

The invention relates to rotary impact tools of the type for applying a torque force on a member for rotatively driving such member and, more particularly, to impact tools as exemplified in the U.S. Pat. to Swenson, Nos. 3,156,309, dated Nov. 10, 1964, and 3,108,506, dated Oct. 29, 1963.

BACKGROUND OF THE INVENTION

In rotary impact tools of the type disclosed in the above mentioned patents, input, output and inertia members are journaled upon each other at mating, mutually telescoping circular surfaces for independent rotative movement about a common axis. A pawl and ratchet assembly is provided for intermittently interconnecting the input, output and inertia members together for torque transmission, the pawl being carried by the inertia member and spring biased toward engagement with the ratchet while the ratchet is connected to the output member. A power spring means interconnects the input and inertia members for storing energy upon relative angular movement of the input inertia and output members and releasing such stored energy to accelerate angular rotative movement of the inertia member when the pawl is disengaged from the ratchet. A cam is provided on the input member which coacts with the pawl upon relative angular movement of the input and inertia members to disengage the pawl from the ratchet and release the pawl for impact engagement with the ratchet to thereby rotatively drive the output member. Thus, as long as the input member is angularly moved, the escapement and impact-producing re-engagement of the pawls and ratchet occurs as a function of angular movement of the input member in overrunning or overhauling relation to the output member and inertia member. To achieve rotation of the output member in an opposite direction, the output member is provided with two output end portions each of which is alternately used to drive the member to be rotatively driven. Thus, to achieve a change in the direction of rotation, the impact tools must be disconnected and turned end-to-end to present a different end of the output member for connection to the member to be driven. This would, in the power driven tools as distinguished from the manually operated tools, require disconnection and reconnection with the source of rotative power to effect change in the direction of rotation of the output member. In addition to this shortcoming of present rotary impact tools, the tools in order to change the force of the impacts require a change in the number and/or strengths of the spring or springs to increase or decrease the spring force. To effect such force change, obviously, is time-consuming and inconvenient. These and other disadvantages of known impact tools of the type herein described are eliminated by the present invention.

It is, therefore, an object of this invention to provide a rotary impact tool of the type having a ratchet and pawl assembly which tool is capable of bi-directional impact rotative drive.

It is another object of this invention to provide a rotary impact tool, of the type having a ratchet and pawl assembly which tool is capable of being quickly and easily adjusted to deliver impacts of different magnitudes and in different direction of rotation.

Another object of this invention is to provide a rotary impact tool of the type having a ratchet and pawl assembly which is capable of driving without ratcheting action.

A still further object of this invention is to provide bi-directional rotary impact tool of the type having a pawl and ratchet assembly in which, in each direction of rotation, the force of the impacts can be varied quickly and easily without change of the force spring or springs.

SUMMARY OF THE INVENTION

It is, therefore, contemplated that a novel rotary impact tool for applying a torque force be provided comprising an input, output and inertia members which are constructed and arranged about a common axis and journaled upon each other at mating, mutually telescoping circular surfaces thereof for independent angular movement about the common axis. A pawl and ratchet assembly is provided which assembly comprises a plurality of circumferentially spaced teeth connected to the output member for conjoined angular movement with the latter and at least one pair of juxtaposed pawls. The pawls are carried by the inertia member for angular movement therewith and each pawl is biased for engagement with the opposite sides of the ratchet teeth and capable of movement out of engagement with the ratchet teeth. A spring means is connected to the inertia and input members to store energy upon relative angular rotative movement between the input and inertia members and during engagement of the pawls with the teeth and to release the stored energy by angularly accelerating the inertia member upon disengagement of one of said pawls from the teeth. A cam engageable with said pawls is carried by the input member and is angularly adjustable relative to the input and inertia members to provide in one position of adjustment one pawl operative for impacting against a tooth of the ratchet teeth in one direction of rotation and in another position of adjustment render the other pawl operative for impacting against a tooth of said teeth in the opposite direction of rotation. The cam functions in coaction with the pawls upon relative angular movement between the input, output and inertia members to force the pawls out of engagement with the ratchet teeth in either direction of rotation and releasing the pawls so that one of the pawls, depending upon the direction of rotation, impacts against a tooth of the ratchet teeth to rotatively drive the output member. The output member, as is conventional, is connected to a member as for example a fastener which is to be rotated to, in turn, rotatively drive the member in one direction or the other.

In another embodiment of this invention, a first cam is fixedly carried by the input member to effect engagement and disengagement of the pawls upon relative angular rotation of the input and inertia members and an adjustment means is provided for selectively preventing one of said pair of pawls from impacting against a tooth of the ratchet teeth so that impacting only occurs in one direction. In a narrower aspect of this embodiment, the adjustment means includes a second cam mounted for angular movement relative to the input and inertia members to hold one of the pawls out of impact engagement with said teeth.

In a still further embodiment of the invention, only one pair of juxtaposed pawls is provided which coacts with a cam fixedly secured for conjoined rotation with the input member which cam is so positioned and shaped as to effect impacting of one or the other of the pawls against the ratchet teeth in response to rotation in either direction while holding the other pawl out of engagement during acceleration of the inertia member and impacting.

In addition to the rotary impact tool of this invention being quickly and easily adjustable to provide impacting in both directions of rotation, it is capable of being quickly and easily adjusted to vary the force of such impacts in each direction of rotation. This latter function is provided for by an adjustment means connected to the cam for rotatively moving the cam relative to the input member so as to preset the amount of relative angular rotation between the input member and inertia member before the pawls are released for impact engagement with a tooth of the ratchet teeth.

In a more limited aspect of this invention, the adjustment means comprises a handle disposed exteriorly to the output member and connected to the cam to rotate the latter, the handle being held in an adjusted position to the output member by a detent means to rotate with the latter by a detent means.

BRIEF DESCRIPTION OF THE DRAWINGS

The invention will be more fully understood from the following detailed description thereof when considered in connection with the accompanying drawing wherein three embodiments of the invention are illustrated by way of example and in which.

DESCRIPTION OF THE PREFERRED EMBODIMENTS

Figure 1:
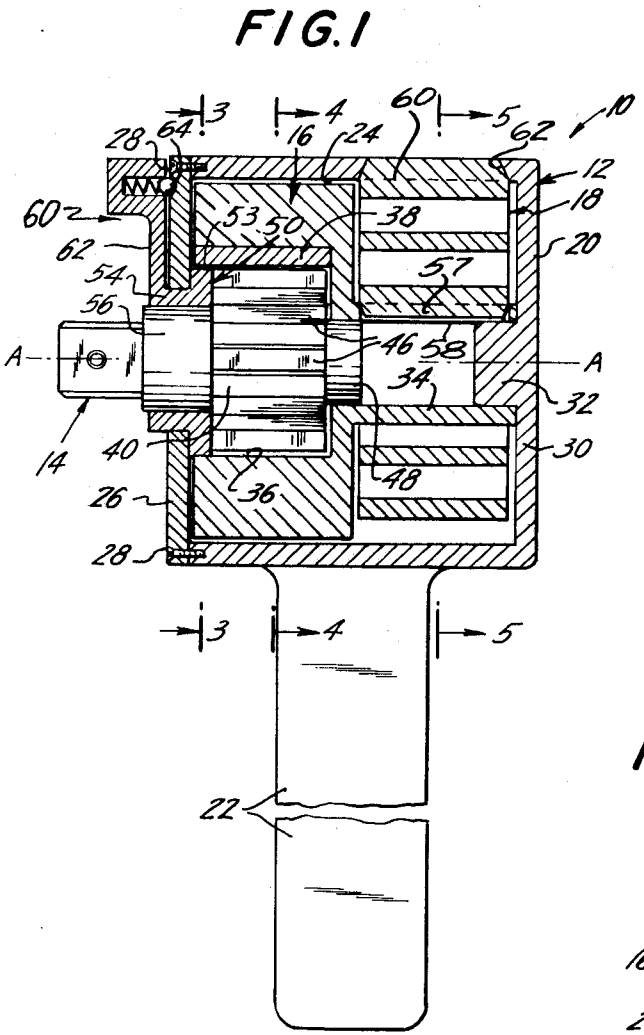
FIG. 1 is a cross-sectional view of a manually operated rotary impact mechanism according to a first embodiment of this invention which view is taken substantially along line 1—1 of FIG. 2.
Figure 2:
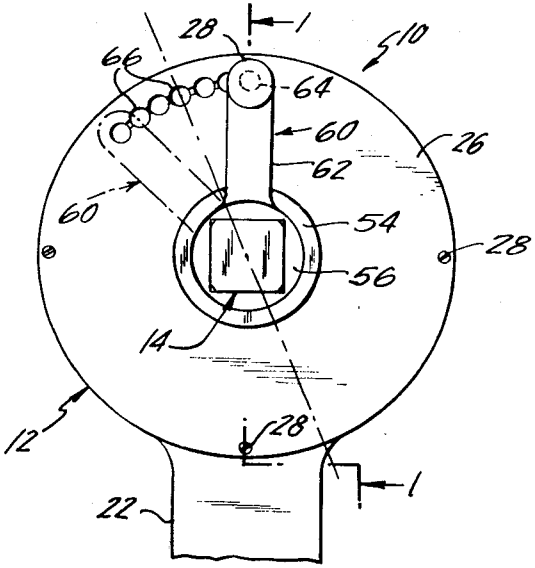
FIG. 2 is a fragmentary elevational view of the rotary impact mechanism shown in FIG. 1 as viewed from the output end of the mechanism.

Now referring to the drawings and more specifically FIGS. 1 to 5, the reference number 10 generally designates a manually operative rotary impact mechanism according to one embodiment of this invention.

Figure 5:
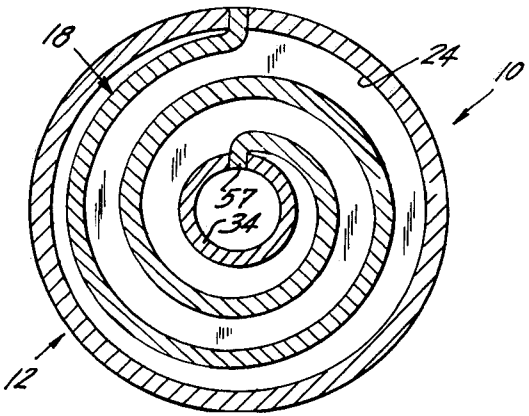
Figure 8:
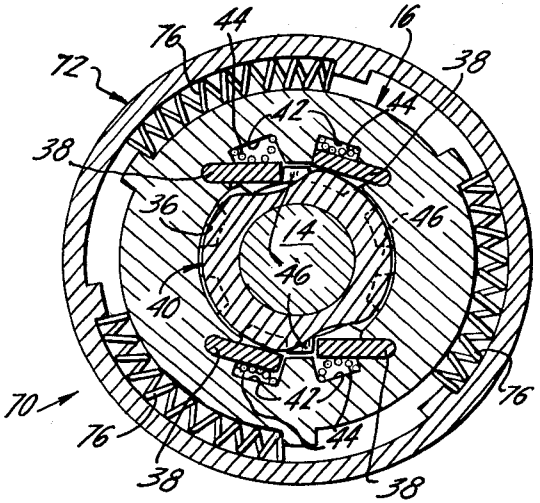
FIGS. 7 and 8 are cross-sectional views taken, respectively, substantially along lines 7—7 and 8—8 of FIG. 6 to show two operative positions of the mechanism.
Figure 7:
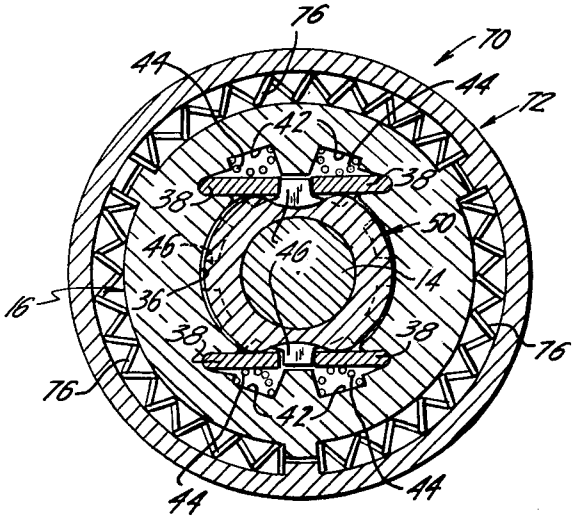
Figure 6:
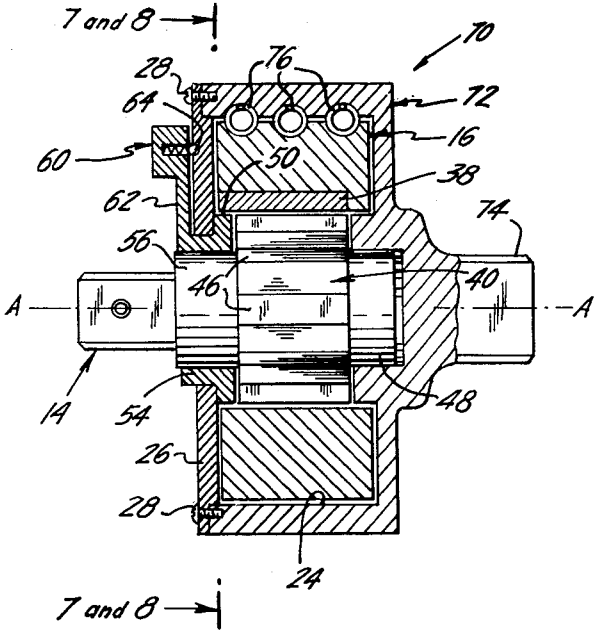
FIG. 6 is a cross-sectional view of a power driven rotary impact mechanism according to a second embodiment of this invention.

The mechanism 10 comprises, in general, an input member 12, an output member 14 and a rotor or inertia member 16 arranged about a common axis A—A and journaled upon each other at mating, mutually telescoping, circular surfaces thereof. A power spring assembly 18 is provided to interconnect inertia member 16 and input member 12 and to store energy upon relative angular movement between those members and thereafter release such stored energy by angularly accelerating inertia member 16. The spring assembly 18 as shown in FIG. 5 is a spirally wound, flat spring, although mechanism 10 may have, as shown in FIGS. 6 to 8 of the drawings, a spring assembly comprising a plurality of helically wound springs without departure from the scope and spirit of this invention. The input member 12 comprises a cylindrical head portion 20 having a longitudinal axis coinciding with the common axis A—A and a handle 22 extending normal to the longitudinal axis of head portion 20. The head portion 20 has a longitudinally extending cylindrical cavity 24 extending from an open end which is closed by a ring-shaped end wall 26, the wall being secured to the periphery of the open end by a suitable means, such as screws 28. The end-wall 30, opposite to wall 22, is provided with an axial projection 32 extending into cavity 24. The projection 32 is dimensioned to project into a tubular hub portion 34 of inertia member 16 to assist in the support of inertia member 16 for rotative movement in cavity 24.

The inertia member 16 has an axially extending recess 36 in which is disposed output member 14. The inertia member carries diametrically opposite each other two pairs of juxtaposed pawls 38 which form part of a ratchet assembly, the other part of the ratchet assembly being ratchet teeth 40 connected for conjoined rotation with output member 14 and forming an integral part of the output member. Each pawl is pivotally mounted in a radial recess 42 in the inertia member which recess communicates with axial recess 36. Each pawl 38 is biased by a spring 44 in a direction toward common axis A—A and into recess 36 for engagement with a tooth 46 of ratchet teeth 40. The interior of tubular hub portion 34 of the inertia member 16 communicates with axial recess 36 so as to receive an end portion 48 of output member 14 and thereby serve as a bearing for one end of output member 14. The pawls 38 of each pair of pawls are so constructed and arranged that each pawl of such pair of pawls functions to engage an opposite side of a tooth 46. To effect pivotal movement of pawls 38 into an out of engagement with ratchet teeth 40, a cam 50 is provided.

Figure 3:
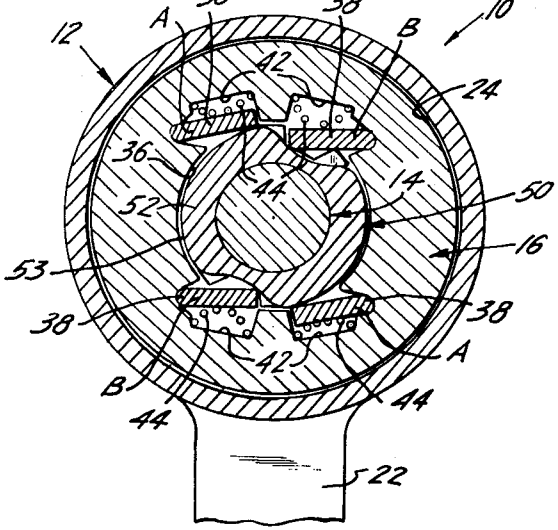
FIGS. 3, 4 and 5 are cross-sectional views taken, respectively, substantially along lines 3—3, 4—4 and 5—5 of FIG. 1.
Figure 4:
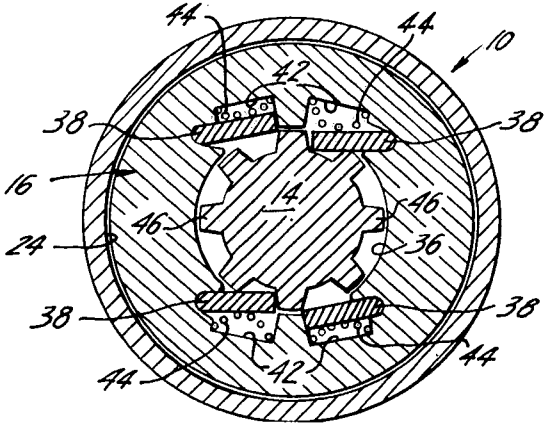

The cam 50, as best shown in FIGS. 1 and 3, has two diametrically opposite lobe portions 52 to form a camming surface 53 which simultaneously pivotally actuates pawls 38 of each pair of pawls. The cam 50 has a tubular hub portion 54 which extends between the central opening of ring-shaped wall 26 and an axial hub 56 of output member 14. This hub portion 54 serves to support for rotation in cooperation with tubular extension 34 of inertia member 16, output member 14.

The power spring 18 as previously stated may, as shown, be a spirally wound flat spring. The spring has at one end a tang portion 57 which is inserted in a slot 58 in tubular hub portion 34 of inertia member 16 to be connected to the latter. At the opposite end, the spring is provided with a tang portion 60 which enters a slot 62 in input member 12 so that the spring is also connected to the input member.

In the operation of mechanism or tool 10, cam 50 functions upon relative rotation between input member 12, inertia member 16 and output member 14, as for example when the torque load on the output member 14 is of a magnitude as to prevent the output member from angularly moving which, in turn, through the ratchet and pawl assembly prevents the inertia member from angular movement, to permit a pawl 38 of each pair of pawls to maintain contact with a tooth 46 for a predetermined relative angular movement of input member 12 and inertia member 16. This relative rotation between input member 12, inertia member 16 and output member 14, as previously stated, causes spring 18 to store energy. When cam 50 which is carried by input member 12 moves through the predetermined angle of rotation, as for example between about 10° and about 30°, the two pawls 38 engaging the ratchet teeth (hereinafter referred to as "impact pawls") are forced by camming surface 53 at lobe portions 52 out of engagement, while the other two pawls 38 of each pair (referred hereinafter as "non-impact pawls") are held out of engagement by lobe portions 52. Upon disengagement of the impact pawls from ratchet teeth 40, inertia member 16 is freed from output member 14 for independent rotation and inertia member 18 is angularly accelerated in overrunning relationship to input member 12 by the force of the stored energy in spring 18. This carries the impact pawls 38 relative to cam 50 so that the cam allows impact pawls 38, under the force of pawl spring 44, to move into rotative alignment with the other teeth of ratchet teeth 40 to impact thereagainst. The impact of impact pawls 38 against the ratchet teeth rotationally drives output member 14, because during acceleration of inertia member 16 and during impact, drive cam 50 holds the non-impact pawls 38 out of engagement with ratchet teeth 40.

The mechanism 10 is capable of providing for bi-directional impact drive of output member 14 by means of an adjusting means 60 which may be connected to or, as shown, integral with cam 50. The adjusting means 60 may comprise a handle 62 connected at one end to tubular hub portion 54 of cam 50 and extending radially adjacent the outer surface of end wall 26. By arcuate movement of handle 62, cam 50 is rotated relative to the input, inertia and output members so that the cam and its camming surface 53 functions to permit impacting of one pawl 38 of each pair of pawls in one direction of rotation and the other pawl 38 of each pair of pawls in the other direction of rotation. For example, if rotation of output member 14 is desired in the counter-clockwise direction as viewed in FIG. 3 pawls 38 of each pair of pawls, designated A, are held out of engagement with ratchet teeth 40 and the other pawls 38 of each pair of pawls, designated B, are permitted by cam 50 to impact against the ratchet teeth. if clockwise rotation of output member 14 is desired, as viewed in FIG. 3, then handle 60 and cam 50 are rotated past the centerline of the total throw of handle 60 to thereby index cam 50 relative to input member 12 and inertia member 16 so that pawls 38 (designated B) are forced and held out of engagement with ratchet teeth 40, while pawls 38 (designated A) are permitted by cam 50 to move into and out of engagement with the ratchet teeth for impacting thereagainst.

The handle 60 and, hence, cam 50 are held in an adjusted position and rotatively connected to input member 12 by any suitable means such as a detent means. The detent means may comprise, as shown, a spring-loaded pin or ball 64 carried in handle 60 and adapted to engage one of a plurality of arcuately spaced recesses 66 provided in the outer surface of end wall 26 (see FIG. 2). The engagement of ball 64 in the extreme endmost recesses 66 provides for rotation in one direction or the other with maximum impacting in each direction. To vary the force of impacting in one direction or the other, the handle 60 can be adjusted so that the ball 64 engages one of the recesses 66 located between the outermost recess and the recess 66 at the centerline. With handle 62 adjusted so that ball 64 engages recess 66 at the centerline, no impacting will occur in either direction and the mechanism functions in the manner of a manual, fixed-wrench since, in that position, the non-impacting pawls 38 are not held out of engagement with ratchet teeth 40 at the time of impact of the other impact pawls and, therefore, no impact drive of output member 14 occurs.

The cam adjustment for regulating the magnitude of the force of the impact blows in each direction of rotation is achieved herein without resorting to the change of power spring or springs because cam 50 in any position between the outermost recess 66 and the recess 66 at the centerline reduces the amount of relative angular movement between input member 12 and inertia member 16 and, hence, reduces the amount of energy stored in spring 18 before disengagement of the pawls 38 from teeth 40 so that the angular acceleration of the inertia member 16 is, in turn, less. Thus, in accordance with the formula $E=\frac{1}{2}MV^2$, wherein E is force, M is mass of the inertia member and V is velocity, the less velocity or acceleration imparted to the inertia member 16, the less the impact force. Therefore, as an example, $\frac{1}{2}$ the impact force would occur at a cam position which is 70.7% of the position for maximum velocity and impact and $\frac{3}{4}$ of maximum strength of the impacts would occur with cam 50 positioned at 86.6% of the position for maximum velocity and impact.

In FIGS. 6, 7 and 8 is shown a rotary impact tool or mechanism 70 according to a second embodiment of this invention which differs from mechanism 10 shown in FIGS. 1 to 5 in that mechanism 70 is adapted to be driven by a source of rotary power, such as an electric, hydraulic or pneumatic motor and utilizes a plurality of helically-wound, circumferentially arranged, springs instead of a spirally-wound flat spring. In view of the similarities of mechanisms 10 and 70, parts of mechanism 70 which correspond to or are like parts of mechanism 10, will be designated by the same reference numbers.

The mechanism 70 has an input member 72 which is adapted to be power-driven rather than manually-driven as is input member 20 mechanism 10 and accordingly has, in place of a handle, a hub portion 74 coextensive with common axis A—A and adapted to be gripped by a chuck (not shown) or other gripping means of a source of rotary power (not shown). In place of spirally-wound spring 18 which forms part of mechanism 10, the mechanism has a plurality of helically-wound springs 76 which are disposed in sets arranged circumferentially between the outer surface of inertia member 16. Each spring 76 is connected at one end to impact member 72 and at the opposite end to inertia member 16. Thus, upon relative rotative movement between input member 72 and inertia member 16, in either direction, springs 76 are compressed to store energy and expand to accelerate inertia member upon disengagement of pawls 38 (see FIGS. 7 and 8). The mechanism 72 has, as previously described with respect to mechanism 10, the same ratchet and pawl assembly and cam 50 for effecting intermittent impacts of the pawls 38 against ratchet teeth 40 to angularly drive output member 14. Also mechanism 72 has the same adjustment means 60 connected to cam 50 to effect adjustment of cam 50 for bi-directional impact drive and, in each direction of rotation, the strength of the impacts, as shown and described for mechanism 10.

The mechanism 72 operates and is adjustable in the same manner as described for mechanism 10 except that it is power-driven rather than manually actuated. Since mechanism 72 is power-operated, the pawl springs 44 may be of the leaf type disclosed in U.S. Pat. to Anderson, No. 4,106,572 dated Aug. 15, 1978 in place of the conical shaped springs disclosed in FIGS. 7 and 8 of the drawings. Also, it is contemplated that there be provided in mechanism 70 an interconnection by some means (not shown) such as a linkage assembly, between the adjustment means 60 and the reversing switch of the source of rotary power (not shown) to prevent improper rotation settings or adjustments.

Figure 11:
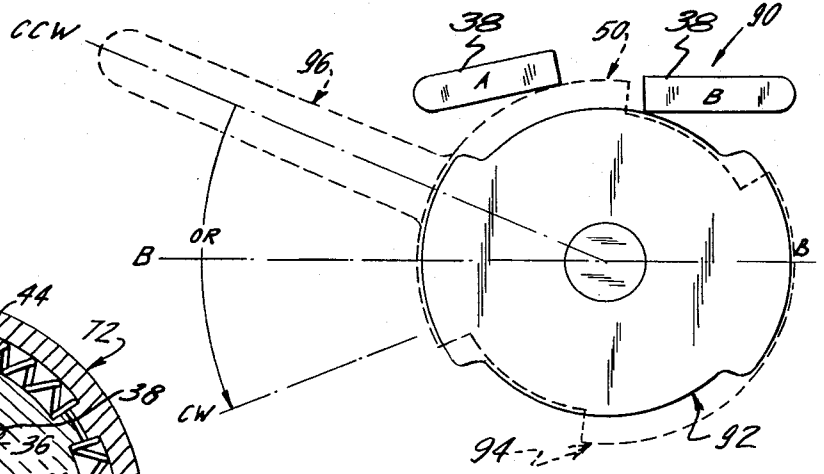
FIG. 11 is a schematic illustration of a rotary impact mechanism according to a fourth embodiment of the present invention.
Figure 10:
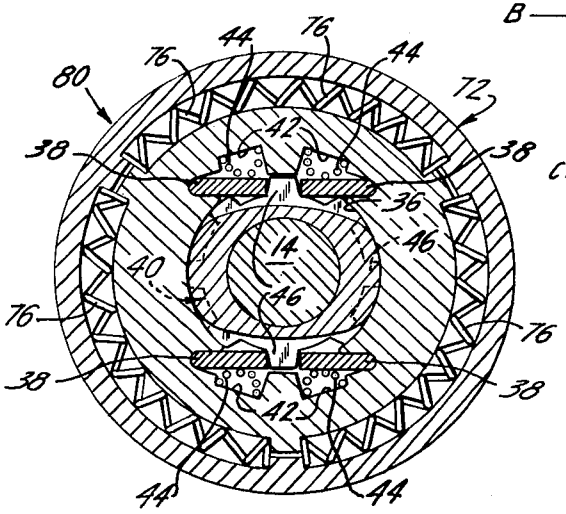
FIGS. 9 and 10 are cross-sectional views similar to FIGS. 6 and 7 showing a rotary impact mechanism according to a third embodiment of this invention.
Figure 9:
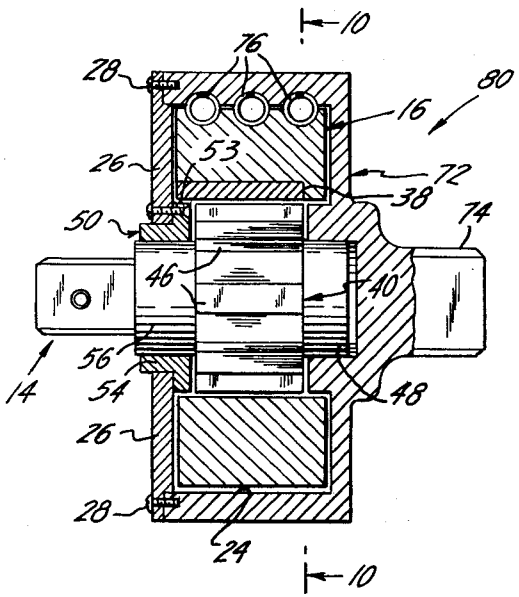

In FIGS. 10 and 11 is shown a power-driven rotary impact tool or mechanism 80 which is almost identical with mechanism 70 and, therefore, parts of mechanism 80 corresponding to like parts or mechanism 20 are identified by the same reference numbers. Mechanism 80 only differs from mechanism 70 in that cam 50 is fixedly secured in a preset position to input member 72 and has a camming surface 53 so shaped that in either direction of rotation one pawl 38 of each pair of pawls 38 are held out of engagement with ratchet teeth 40 during acceleration of the inertia member 16 and during impacting of the other pawls 38 of each pair of pawls 38.

In FIG. 11 is schematically shown a still further embodiment of this invention in which a bi-directional impact tool or mechanism 90 has a fixed cam 92 (shown in full lines) adjacent the ratchet teeth (not shown) of an output member (not shown) and an adjustable cam 94 and adjustment means 96 (shown in broken lines) similar to cam 50 and adjustment means 60 of mechanisms 10 and 70. Only one pair of juxtaposed pawls 38 are provided in mechanism 90. In this mechanism 90 any position of adjustment means 96 between a position of maximum force and the centerline B—B will produce unwanted functions or no action.

It is believed now readily apparent that the present invention provides a manually actuated or power-driven rotary impact tool or mechanism of the type having a pawl and ratchet assembly which is capable of impacting in both directions of rotation. In some embodiments of the invention, the force of the impacts in both directions of rotation can be adjusted quickly and easily and without the need for changing the power spring or springs and/or the number of power springs.

Although several embodiments of the invention have been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. A bi-directional rotary impact mechanism comprising:

(a) an input member;

(b) an output member;

(c) an inertia member;

(d) said input, output and inertia members being all disposed about a common axis and journaled upon each other at mating, mutually telescoping circular surfaces thereof for independent angular movement about said axis;

(e) a plurality of circumferentially spaced teeth connected to said output member for conjoined angular movement with the latter;

(f) at least one pair of juxtaposed pawls carried by the inertia member for angular movement therewith and the pawls biased for engagement with the opposite sides of said teeth and capable of movement to disengage from the teeth;

(g) spring means connected to the inertia and input members to store energy upon relative angular rotative movement between the input and inertia members and during engagement of said pawls with said teeth and to release the stored energy by angularly accelerating said inertia member upon disengagement of one of said pawls from said teeth;

(h) a cam engageable with said pawls and carried by the input member and angularly adjustable relative to the input and inertia members to provide in one position of adjustment one pawl operative for impacting against a tooth of said teeth in one direction of rotation and in another adjusted position render the other pawl operative for impacting against a tooth of said teeth in the opposite direction of rotation; and (i) said cam coacting with said pawls upon relative angular movement between the input, output and inertia members to force said pawls out of engagement with the teeth in either direction of rotation and releasing pawls so that one of the pawls, depending upon the direction of rotation and cam adjustment, impacts against a tooth of said teeth to rotatively drive the output member.

2. The apparatus of claim 1 wherein an adjusting means is connected to said cam for angularly moving said cam to an adjusted position to thereby effect impact between a pawl and a tooth of said output member.

3. Apparatus of claim 3 wherein said adjusting means includes locking means for connecting said cam in an adjusted position for conjoined rotation with the input member.

4. The apparatus of claim 3 wherein said lock means is a detent.

5. The apparatus of claim 1 wherein each of said pawls is spring biased in a direction toward said teeth.

6. The apparatus of claim 1 wherein said spring means is a spirally-wound spring connected at one end to the inertia member and at the opposite end to the input member.

7. The apparatus of claim 1 wherein said spring means is a plurality of coil springs disposed to extend normal to said common axis and arcuately between the inertia member and the input member so that upon relative rotative movement the coil springs are compressed to store energy.

8. The apparatus of claim 7 wherein said plurality of coil springs comprises springs circumferentially spaced about the outer surface of the inertia member.

9. The apparatus of claim 1 wherein said mechanism has a handle attached to said input member to extend radially therefrom for manually rotatively actuating the mechanism.

10. The apparatus of claim 1 wherein said input member is provided with a member for facilitating connection of the input member with a source of rotary power.

11. A bi-directional rotary impact mechanism comprising (a) an input member;

(b) an output member;

(c) an inertia member;

(d) said input, output and inertia members being all disposed about a common axis and journaled upon each other at mating, mutually, telescopic circular surfaces thereof for independent angular movement about said axis;

(e) said output member having a plurality of circumferentially spaced teeth;

(f) two pair of pawls disposed diametrically opposite each other and carried by the inertia member for angular movement therewith;

(g) each pawl of each pair of pawls being juxtaposed to each other and being biased toward the teeth of the output member for engagement with the opposite sides of a tooth of said teeth and capable of movement out of engagement with the teeth;

(h) spring means connected to the inertia and input members to store energy upon relating angular rotative movement between the input, output and inertia members and during engagement of said pawls with said teeth of the output member and to release such energy by angularly accelerating said inertia member upon disengagement of said pawls from said teeth; and (i) a cam carried by the input member and angularly adjustable relative to the input member to provide in one position of adjustment and upon relative angular movement between the input, output and inertia members in one direction of rotation the forcing of the pawls of each pair of pawls out of engagement with the teeth of the output member and releasing the pawls for engagement with said teeth so that one pawl of each pair of pawls impacts against other teeth to rotatively drive the output member in said one direction and in another position of adjustment force each pair of pawls out of engagement with the teeth and releasing the pawls for engagement with said teeth so that the other pawl of each pair of pawls impacts against other teeth to rotatively drive the output member in a direction opposite said one direction.

12. The apparatus of claim 11 wherein an adjusting means is connected to said cam to rotate the latter and including detent means for connection with the input member in a preselected initial position of adjustment.

13. The apparatus of claim 11 wherein said spring means is a spirally formed spring.

14. The apparatus of claim 11 wherein said spring means comprises a plurality of helically wound springs arranged to extend arcuately along the outer peripheral surface of the inertia member and inner peripheral surface of the input member.

15. The apparatus of claim 11 wherein said cam has two diametrically opposite lobes to provide four displacement camming surfaces.

16. A rotary impact mechanism comprising:

(a) an input member;

(b) an output member;

(c) an inertia member;

(d) said input, output and inertia members being all disposed about a common axis and journaled upon each other at mating, mutually, telescopic circular surfaces thereof for independent angular movement about said axis;

(e) a plurality of circumferentially spaced teeth carried by the output member;

(f) pawl means carried by the inertia member for angular movement therewith and being biased for engagement with a tooth of said teeth and capable of movement to disengage from the tooth;

(g) spring means connected to the inertia and input members to store energy upon relative angular rotative movement between the input and inertia members and during engagement of said pawl means with said tooth of the output member and to release such stored energy by angularly accelerating said inertia member upon disengagement of said pawl means from said tooth;

(h) a cam carried by the input member and operative on said pawl as a function of relative angular movement of the input member and inertia member in a direction to force the pawl means out of engagement with one tooth of said teeth and release such pawl means for engagement with another tooth to impact thereagainst and rotatively drive the output member; and (i) adjustment means connected to said cam for rotatively moving said cam relative to the input member so as to preset the amount of relative angular rotation between the input member and inertia member before the pawl means is released for engagement with a tooth of said output member and thereby provide for a predetermined impact force.

17. The apparatus of claim 16 wherein said pawl means includes at least a pair of juxtaposed pawls each of which is biased for engagement with the opposite sides of said teeth and capable of movement to disengage from the teeth and wherein said cam provides in one adjusted position one pawl operative for impacting against a tooth of said teeth in one direction of rotation and in another adjusted position the other pawl operative for impacting against a tooth of said teeth in the opposite direction of rotation.

18. A rotary impact mechanism comprising (a) an input member;

(b) an output member;

(c) an inertia member;

(d) said input, output and inertia members being all disposed about a common axis and journaled upon each other at mating, mutually, telescopic circular surfaces thereof for independent angular movement about said axis.

(e) a plurality of circumferentially spaced teeth carried by the output member;

(f) at least a pair of juxtaposed pawls carried by the inertia member for angular movement therewith and each pawl being biased for engagement with the opposite sides of said teeth and capable of movement to disengagement from the teeth;

(g) spring means connected to the inertia and input members to store energy upon relative angular rotative movement between the input and inertia members and during engagement of one of said pawls with said tooth of the output member and to release such stored energy by angularly accelerating the inertia member upon disengagement of said one pawl from said tooth;

(h) a cam carried by the input member and operative on said pawls to release one of said pawls for engagement with a tooth of said teeth and to force said one pawl out of engagement with said tooth upon relative angular rotative movement between the input member and the inertia member; and (i) adjustment means including a second cam means rotatable with said input member and adjustable angularly relative to the latter and said inertia member to engage said pawls and capable of selectively holding one of said pawls out of impact engagement with said teeth so that impacting only occurs in one direction of rotation.

19. The mechanism of claim 18 wherein a handle is disposed exteriorly of the input member and is connected to the cam to be rotated.

20. The mechanism of claim 19 wherein a detent means coacts with said handle and input member to said input member to hold the cam in a selected position.

21. A bi-directional rotary impact mechanism comprising:

(a) an input member;

(b) an output member;

(c) an inertia member;

(d) said input, output and inertia members being all disposed about a common axis and journaled upon each other at mating, mutually telescoping circular surfaces thereof for independent angular movement about said axis;

(e) a plurality of circumferentially spaced teeth connected to said output member for conjoined angular movement with the latter;

(f) at least one pair of juxtaposed pawls carried by the inertia member for angular movement therewith and the pawls biased for engagement with the opposite sides of said teeth and capable of movement to disengage from the teeth;

(g) spring means connected to the inertia and input members to store energy upon relative angular rotative movement between the input and inertia members and during engagement of said pawls with said teeth and to release the stored energy by angularly accelerating said inertia member upon disengagement of one of the pawls from said teeth; and (h) a cam fixed to said input member for rotative movement therewith and having a camming surface so formed as to engage said pawls and coact with said pawls to provide for impact engagement of one pawl with said teeth while holding the other pawl out of engagement during acceleration of the inertia member and thereby provide rotative impacting in one direction of input rotation;

(i) said cam being positioned initially relative to the input inertia and output members and having a camming surface so contoured that each pawl is in engagement with the teeth and to effect disengagement of either pawl requires in either direction of rotation the same angular movement of the input member relative to the inertia member.

* * * * *

UNITED STATES PATENT AND TRADEMARK OFFICE

CERTIFICATE OF CORRECTION

PATENT NO. : 4,243,109

DATED : January 6, 1981

INVENTOR(S) : J. Edward C. Anderson

It is certified that error appears in the above—identified patent and that said Letters Patent is hereby corrected as shown below:

Column 8, claim 3, line 1, "claim 3" should read -- claim 2 --.

Column 8, claim 11, line 64, Column 9, claim 16, line 54 and Column 10, claim 18, line 35, "mutually, telescopic", each occurrence, should read -- mutually telescoping --.

Signed and Sealed this

*Eighteenth* Day of *August 1981*

[SEAL]

*Attest:*

GERALD J. MOSSINGHOFF

*Attesting Officer*

*Commissioner of Patents and Trademarks*